United States Patent [19]

Azumano

[11] 3,937,227

[45] Feb. 10, 1976

[54] TOBACCO LEAF CURING SYSTEM

[75] Inventor: Hideyuki Azumano, Kagoshima, Japan

[73] Assignee: Sansyu Sangyo Co., Ltd., Kagoshima, Japan

[22] Filed: Feb. 28, 1974

[21] Appl. No.: 446,766

[52] U.S. Cl. ..... 131/134; 131/135; 34/46; 34/225

[51] Int. Cl.[2] ..... A24B 1/02

[58] Field of Search ..... 131/134, 135, 140; 34/225, 34/46

[56] References Cited

UNITED STATES PATENTS

| | | | |
|---|---|---|---|
| 585,759 | 7/1897 | Hysore | 131/134 X |
| 1,968,764 | 7/1934 | Harris | 34/225 X |
| 2,097,168 | 10/1937 | Vellner | 131/135 |
| 2,229,942 | 1/1941 | Touton | 131/135 X |
| 2,606,372 | 8/1952 | Foulder et al. | 34/225 X |
| 2,779,105 | 1/1957 | Park | 34/225 X |
| 3,233,339 | 2/1966 | Long et al. | 131/140 R X |
| 3,397,465 | 8/1968 | Carmichael | 34/225 |
| 3,664,034 | 5/1972 | Wilson | 131/135 X |

FOREIGN PATENTS OR APPLICATIONS

| | | | |
|---|---|---|---|
| 1,173,780 | 10/1958 | France | 131/134 |

*Primary Examiner*—Joseph S. Reich
*Attorney, Agent, or Firm*—Stewart and Kolasch, Ltd.

[57] ABSTRACT

A tobacco leaf curing system comprising an air tight curing house divided by a porous floor plate into an upper curing barn and a lower blast chamber, the curing barn being provided at its upper portion with a circulation port and an outlet port; a circulation duct passageway containing duct fan means and heating means, said circulation duct passageway communicating with the circulation port for drawing air from the curing barn, said air being compressed by said duct fan means and heated by said heating means and then reintroduced into the blast chamber through a blast port; an automatic temperature regulator associated with the burner of the heating means for automatically igniting or extinguishing said burner according to variations appearing on a wet-bulb temperature sensor so as to regulate the temperature and humidity of the air to be sent to the blast chamber; an inlet control system comprising a cylindrical damper provided with openings and located in said circulation duct system, said inlet control system being so arranged that, with the rotation of said damper, the inlet port is automatically opened in a progressive manner as the leaf setting stage begins and is closed again before the stem drying stage is completed, said inlet control system also varying the mixing ratio of the external air to the recycled, heated air being supplied to the blast chamber for each curing stage; and an outlet port control mechanism which is located at the outlet port opening on a side of said curing barn, said outlet port control mechanism automatically opening or closing according to the amount of air which is drawn through the inlet port of the inlet port control system so that the air which has passed through the curing barn may be partially exhausted through the outlet port to the exterior of said barn.

16 Claims, 23 Drawing Figures

TOBACCO LEAF CURING SYSTEM

BACKGROUND AND SUMMARY OF THE INVENTION

Tobacco leaves cannot be dehydrated and cured or dried by usual physical or mechanical curing or drying means to produce cured leaves of desired quality, because of the special physical structure and characteristics peculiar to their cells. Accordingly, unless the yellow coloring and the curing process is carried out with a proper adjustment of the dehydration speed and drying or curing temperature which does not destroy the cell of leaves, deterioration of the quality of the cured leaves will be the result.

Accordingly, what is important in drying or curing tobacco leaves is to prevent the cell from becoming excessively dried by controlling the humidity on the ambient temperature of the leaves in the curing process and the latent heat transferred to the cell so as not to destroy the cell.

The tobacco leaf curing process is usually divided for convenience into a first half period comprising the preheating stage for fermentation and the yellow coloring stage and a second half period comprising the leaf drying stage and the stem drying stage.

In the first period, saccharification of the ingredients and therefore the chemical and physiological change in the leaves proceeds for about 30 to 40 hours due to the action of the active enzyme in the leaves. During this period the temperature and water content of the leaves is maintained at a proper level.

During the first processing period, the green color of the leaf produced by the chlorophyll content vanishes and a yellow color resulting from the carochine content appears. This yellow color taken on by the leaf is peculiar to ordinary tobacco leaves. The fermentation, preheating, and the yellow coloring stage of the first half period can be carried out selectively and mechanically by conventional circulation drying methods (bulk curing), wherein wet hot air is circulated through the leaf chamber to produce the chemical change in the leaf ingredients.

In the second half period wherein the mesophyll setting and stem drying processes take place, the mesophyll and stem are dried and finished to dried tobacco leaves having a good quality, and a good aroma and smoking property. In the second period, however, an extremely elaborate and complicated adjustment is required and frequently failure in drying and accordingly deterioration in the quality of the leaves occurs, which leads to product and economic loss. The reason for this difficulty or failure is that although the latter half period consists only of the water from the mesophyll, the transition from the first half stage to the latter stage must be very carefully conducted. Thus, the process in the first period should be performed by maintaining such a proper upper temperature limit so as not to destroy the cell while causing the color of the leaves to change to yellow, and then the process should be slowly converted to the leaf drying or dehydration stage in the second half period with great care, without causing a drop in the leaf temperature due to the evaporation of moisture from the leaves.

Most of the failure in the past has been caused by the failure to provide a smooth transition from the first period to the latter period because the changing operations include a complicated temperature and humidity control.

According to the conventional methods of changing slowly from the curing process to the drying process, a "Standard Drying Operation Table" as shown in FIG. 24 has been used. In the conventional method, temperature adjustment was conducted by always checking the difference between the dry-bulb temperature and the wet-bulb temperature of the curing barn while referring to the operation table.

With respect to the relationship between the dry-bulb and the wet-bulb temperatures during the drying process, the following should be noted: The dry-bulb temperature rises successively insteps while the wet-bulb temperature is linerally maintained from the beginning to the end, and up to about 38°C. and then substantially stays there. In the examples which failed, it was found that the wet-bulb temperature fluctuated in wave-like fashion.

It was noted that the water evaporation speed on the surface of the cloth piece covering the wet-bulb in the drying chamber was quite similar to that on the surface of the tobacco leaves. When both evaporation speeds are substantially equivalent, the temperature of both surfaces are quite similar. Accordingly, the temperature of the leaves can be determined by observing the drying degree of the covering cloth of the wet-bulb, i.e., the wet-bulb temperature. In short, to adjust the wet-bulb temperature at about 38°C. is to set the water evaporation speed for the leaf at an evaporation speed level of about 38°C.

Accordingly, in view of the fact that it is necessary to stabilize the wet-bulb temperature at about 38°C. in order to succeed in effectively drying the leaves, one of the purposes of the present invention is to provide a tobacco leaf drying system which dries tobacco leaves perfectly and completely at a natural temperature rise starting from about 43°C. of the dry-bulb temperature, and stabilizing the wet-bulb temperature at about 38°C., also in the second half period. At the beginning of the mesophyll drying stage where moisture in the leaf evaporates actively, most of the heat supplied by the burner is used as latent heat for the evaporation of the water of the leaf and accordingly does not serve to raise the dry-bulb temperature. But in the later part of the mesophyll setting process where the leaf becomes almost dried, the evaporation of the moisture drops, and the amount of latent heat used becomes less. Accordingly a larger amount of the burner heat is used spontaneously to raise the temperature of the dry-bulb. This is called the spontaneous temperature rise of the dry-bulb temperature.

In the mesophyll drying and stem drying stage it is necessary to control the intake and exhaust of the circulating air in the drying chamber (the bulk curing barn) while keeping the wet-bulb temperature set at about 38°C. The air control procedure is an important step in the tobacco leaf drying process, along with the control of the wet-bulb temperature.

Drying of the leaf, i.e., evaporation of the water in the leaf is possible so long as the saturated vapor pressure of the water contained in the leaf is greater than the partial pressure of the vapor contained in the ambient air in the chamber. The greater the differences between said two pressures, the faster is the drying speed. On the other hand because the latent heat is removed from the leaf due to the evaporation of the water, the temperature of the leaf lowers during the drying process.

In an air circulation drying method, the humidity content of the air having once passed through the layers of the leaf, approaches a saturated condition. Accordingly, the air should be reheated to increase the moisture containing capacity of the air. Thus, if only the dehydration of the leaf is desired, all that is necessary is to replace all of the water-containing air which has passed through the tobacco leaf layers by outdoor air. However, in the tobacco leaf drying process, the tobacco leaf should be gradually dried and set while the dehydration velocity and leaf is controlled so that the leaf ingredients change gradually over a long period of time. Accordingly the amount of intake and exhaust air should be maintained within about 5 to 30% of the total circulated air. Thus it becomes necessary as part of the drying process that most of the humid air having passed through the leaf must be reheated during its recirculation and sent into the drying chamber as a reheated hot humid air. This increases the thermal efficiency of the drying system and produces a good economic result.

Accordingly, an object of this invention is to provide a tobacco leaf drying system having an air-inlet opening and closing device which is operated independently of the wet-bulb temperature control device, and in operation, gradually starts to open the inlet when the mesophyll drying stage begins, and closes the inlet by the end of the stem drying stage. This ventilates the humid air having passed through the leaf layers in amounts almost equal to the outdoor air introduced into the chamber, so as to slowly change the mixing ratio of the fresh air taken in and, thereby maintaining the chamber humidity at a proper level while advancing a successful drying operation.

Another object of the present invention is to provide a tobacco leaf drying system which can simplify the tobacco leaf harvesting and handling procedures, such as packing the leaves at the cultivation site, transporting the leaves from the cultivation site to the site of the drying system, feeding the leaves into the chamber without damaging the leaves, drying the leaves as they are harvested, and packing the leaves, thereby greatly reducing the labor costs of the present system when compared with conventional harvesting, handling and drying processes.

A further object of the present invention is to provide a tobacco leaf hanging means used in the drying chamber wherein means are provided for suspending the leaves in the chamber from clamps attached to the bases of the leaves.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENTS

Figure 1:
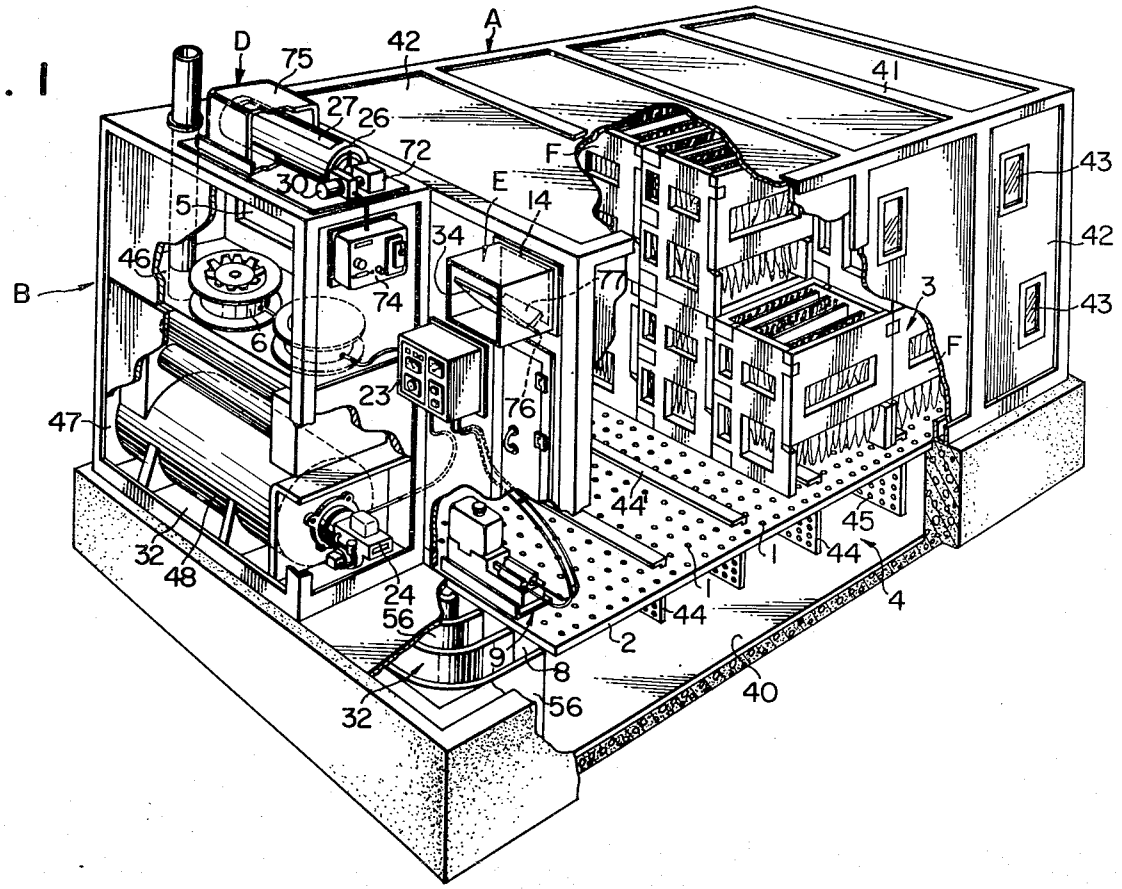
FIG. 1 is a perspective view, partially broken away, showing the entire device of the present invention.

Referring now to the drawings wherein identical reference numerals are used throughout the various views to indicate like elements, the device of the present invention comprises a curing or drying house A which is an assembly type, air tight shed, constructed on a waterproof and heat-insulated base 40, and provided with frames 41 and wall panels 42 made of metal plate or insulating material. A floor plate 2, provided with a number of small holes is installed in the lower portion inside the shed. A drying chamber of curing barn 3 is formed above said plate 2 and a blast chamber 4 is disposed below the floor 2.

Figure 22:
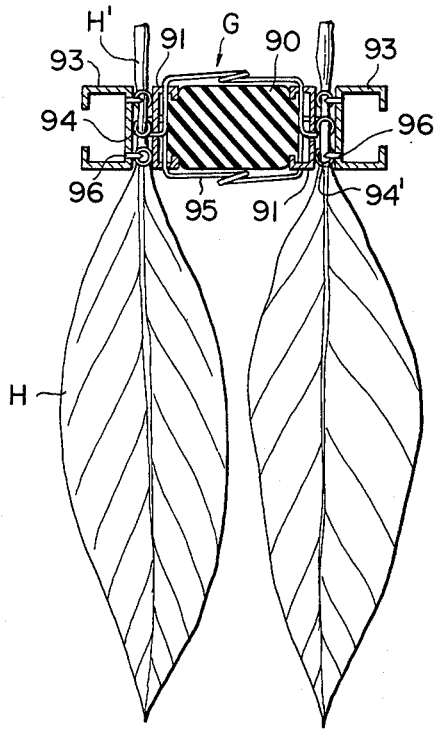
FIG. 22 is a section taken along a line 22—22 in FIG. 21 showing the binder as holding tobacco leaves.
Figure 23:
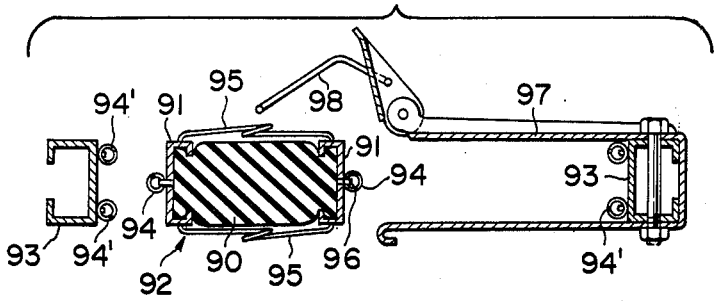
FIG. 23 is a side section showing the binder in a dismantled state.

A door is provided in the sidewall opposite to the side wall behind which is provided air circulation duct passage B. When the door is opened, tobacco leaf storing casings F (leaf containers) packed with tobacco leaves or tobacco leaf hanging bars G (FIG. 22) clamping the tobacco leaves, can be carried in and out. The side walls and the door are provided at specific locations, with observation windows 43 permitting easy observation of the change taking place in the tobacco leaves during the curing process. The curing barn 3 is air tight for drying or curing tobacco leaves H, which are stored in tobacco leaf storage casings piled on the perforated floor 2 or hung by hanging bars G. The leaves are dried and cured by forced and heated air supplied from the blast chamber 4, passing through the small holes 1 and injecting into the chamber 3. The curing chamber 3 is provided in the upper portion of any desired side wall with an air circulation port 5 for drawing humid air having passed through the layers of tobacco leaves H into the air circulation duct system B. Outlet port 14 is also provided at proper locations of any desired wall for exhausting to the outside a part of the humid air which has passed the tobacco leaves H.

The blast chamber 4 uniformly disperses the forced heated air introduced thereinto from the air circulation duct passage B through blast port 8, and introduces the air into the curing barn 3 at a uniform temperature through the small holes 1 of the floor 2. The porous floor plate 2 is made, for example, of steel or plastic plate provided with many small holes across the entire plate. The plate is installed slightly above the blast port 8, thus partitioning the inside space of the curing barn A into an upper part which is used as a drying or curing barn 3 and a lower part which is used as a blast chamber 4. Baffle plates 44 are erected below the floor 2 and at right angles to the advancing direction of the heated air introduced from the blast feed port 8.

The baffle plates 44 are provided with many small openings 45. The top margin of the plate 44 is bent in the form of a L-shaped hook 44'. The plates are inserted through a long slot provided in the floor 2 so that the plate hangs from the floor 2 into the blast chamber. The length of the baffle plates increase as they are further removed from the blast feed port 8 so that the blast chamber may function as a floor duct. Thus, the heated blast passing through the small holes 45 of plates 44 are supplied to the curing barn 3 with equal volume even at the most remote location from the blast port 8.

The circulation duct system B is an air tight ventilation passageway extending from the air circulation port 5 provided in a wall of the blast chamber 4. The passageway B is provided with a duct fan 6 which draws air from the curing chamber 3 through the air circulation port 5 and subsequently compresses said air; a heater 7 which heats the air; an inlet port automatic control system D which is provided between the air circulation port 5 and the duct fan 6 and which functions to draw external air into the system so as to change the mixing ratio of the external air to the circulating air; and a blast distribution chamber 32 constructed to distribute the above forced and heated air uniformly to the blast chamber 4 through the blast feed port 8.

The air circulation duct passage B which contains the blast distribution chamber 32 is also provided with a sealed compartment which is positioned on and connected to the distribution chamber 32. The compartment is constructed as a hollow box shape by panels. The sealed compartment is divided into an upper and a lower chamber by a substantially horizontal partition plate 46. The upper chamber is connected to the lower chamber by the duct fans 6 secured on the partition plate 46. The upper chamber communicates with the air circulation port 5 provided at a location facing the curing barn 3, and the lower chamber is used as a heat exchanging room 47 which houses a heater 7 and communicates at its lower portion with the blast distribution chamber 32.

The heater 7 consists of a burning furnace 48 and its heat source, i.e., a burner 24, both of which are housed in the heat exchange room 47.

The burning furnace 48 is provided with a design employing a furnace shape and a flue pipe connecting system, which provides the desired heat exchange efficiency between the heated air and the circulating air to be heated. The burner 24 is ignited automatically by a signal generated by an automatic temperature control system C.

The circulation air drawn into the heat exchange chamber 47 by the duct fans 6 is heated in the chamber 47 and fed into the blast distribution chamber 32 below the exchange chamber 47.

In order to send the forced, heated air from the blast distribution chamber to the blast chamber 4 uniformly through the blast port 8, the distribution chamber 32 is either provided with an appropriate number of blast guide plates 56 arranged in parallel to the direction of the blast port 8, or is entirely open at one side so as to communicate with the blast port 8.

Figure 7:
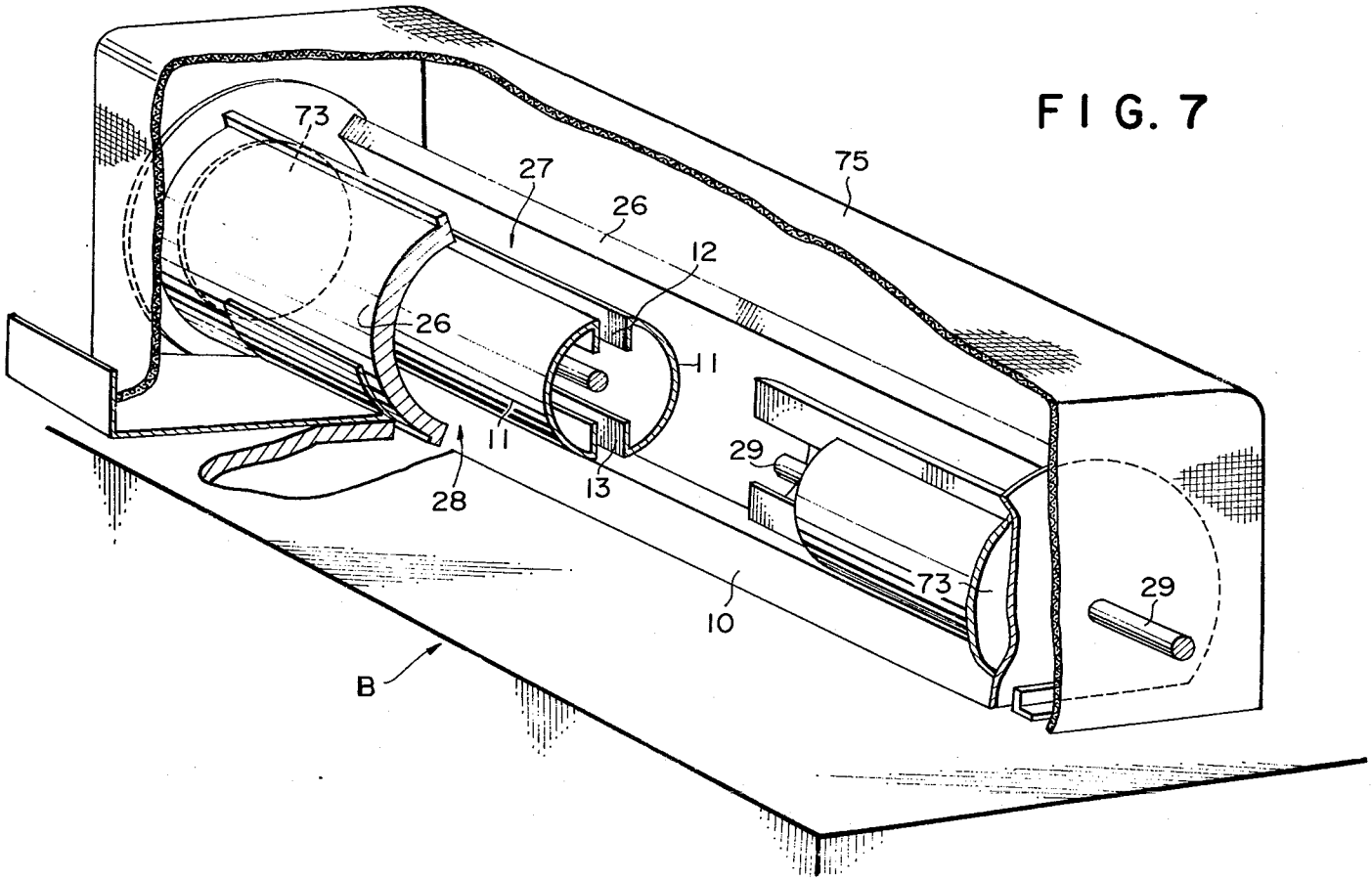
FIG. 7 is a perspective view showing, partially broken away, an inlet port control mechanism.
Figure 8:
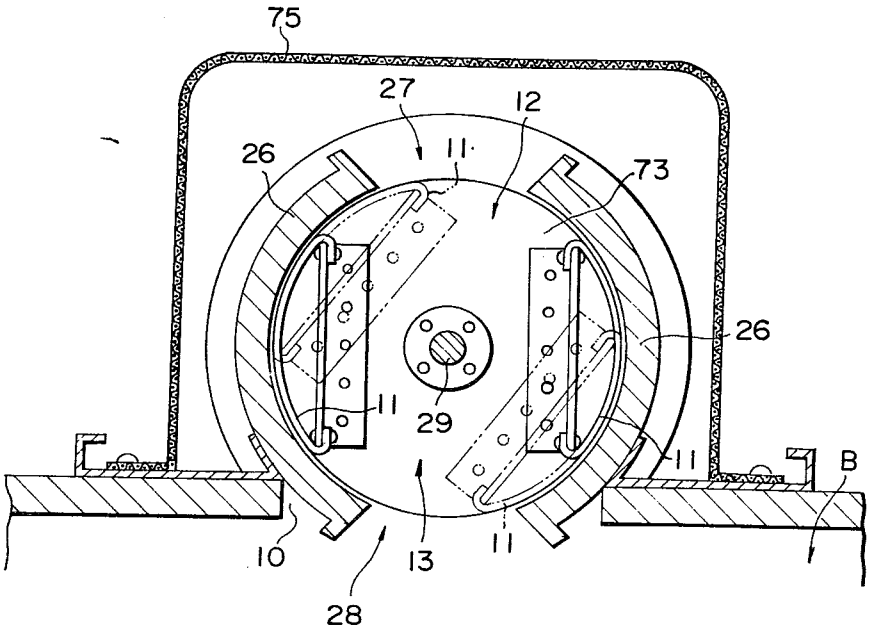
FIG. 8 is a front section showing said inlet port control mechanism.

The inlet port control system D, installed in the duct passage between the air circulation port 5 of the air circulation duct passage B and the duct fan 6, draws into the system external air and changes the mixing ratio of the circulating air. An inlet port 10 (FIG. 7) is provided in the upper surface of the sealed compartment forming the circulation duct passage B. A cylindrical hollow drum 26 is installed laterally in said air inlet port 10 and air passage openings 27 and 28 are provided in the circumferential wall of said drum so as to provide communication between the inside of the circulation duct B and the external air. A damper 11 is slidably fitted in the drum 26. The damper 11 is cylindrical, a little smaller than the hollow drum 26 in diameter, and slides on the inside surface of the drum 26. The damper 11 is provided with rectangular holes 12 and 13 in its body portion and it is rotated by a motor 30 in conjunction with a speed reduction device 72. The damper 11 may be made of two similarly arc shaped plates positioned to face each other, with both ends secured to discs 73. The damper is provided with air passage holes 12 and 13 located vertically. The damper 11 must be so constructed that the vertical air passages 27 and 28 of the hollow drum 26 are opened and closed by rotation of the surface of the damper, thus insuring the opening and closing of the inlet port 10. Furthermore, the damper 11 is connected electrically to automatic control means 74 which generates an electric signal at predetermined intervals, causing the motor 30 to rotate, which in turn rotates the damper to progressively open the inlet port 10. The drum 26 is provided with a cover such as a net plate so as to prevent foreign matter from entering into the circulation duct B from inlet port 10. The automatic control means 74 generates an electric signal at predetermined intervals, during the mesophyll or leaf setting and stem curing stage, causing the electric motor 30 to be rotated for a period of time defined by the timer to which said signal is applied. The damper 11 is slightly rotated to open the inlet port 10 in a progressive manner. That is, the damper moves slowly to a fully opened position as the leaf setting stage progresses, and moves to a rather closed position by the time the stem curing stage begins, and stops at an almost closed position in the leaf curing stage to draw in only a small amount of external air to the recirculated heated air which is sent into the blast chamber 4 is changed.

Figure 2:
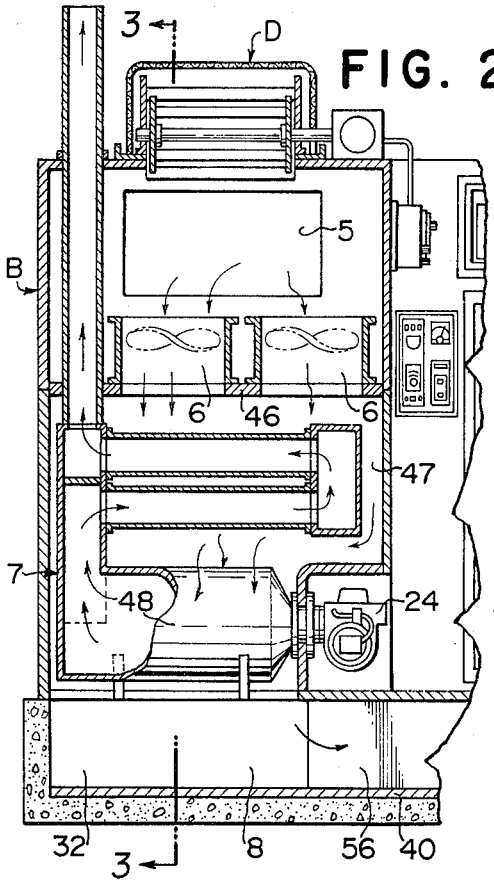
FIG. 2 is a front section of a heater arranged in a circulation duct system.
Figure 3:
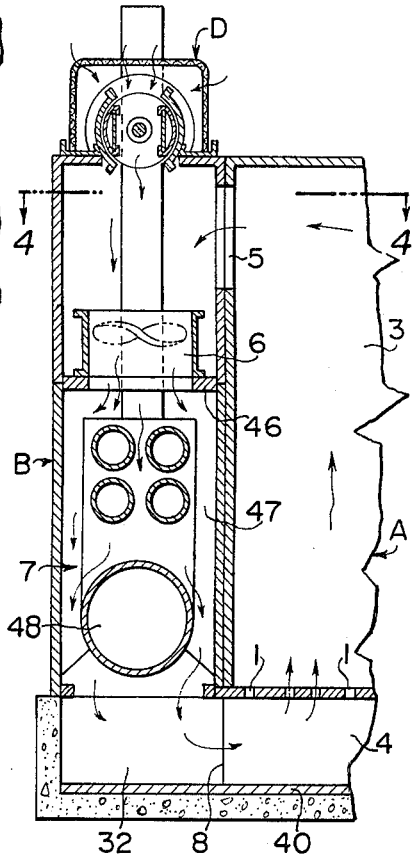
FIG. 3 is a section taken along a line 3—3 in FIG. 2.
Figure 4:
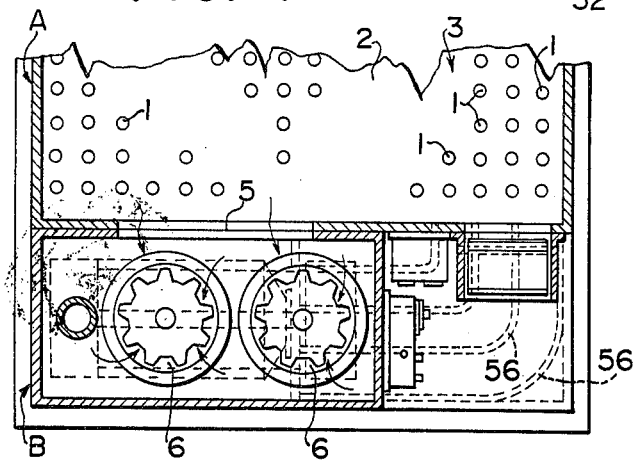
FIG. 4 is a section taken along a line 4—4 in FIG. 3.
Figure 5:
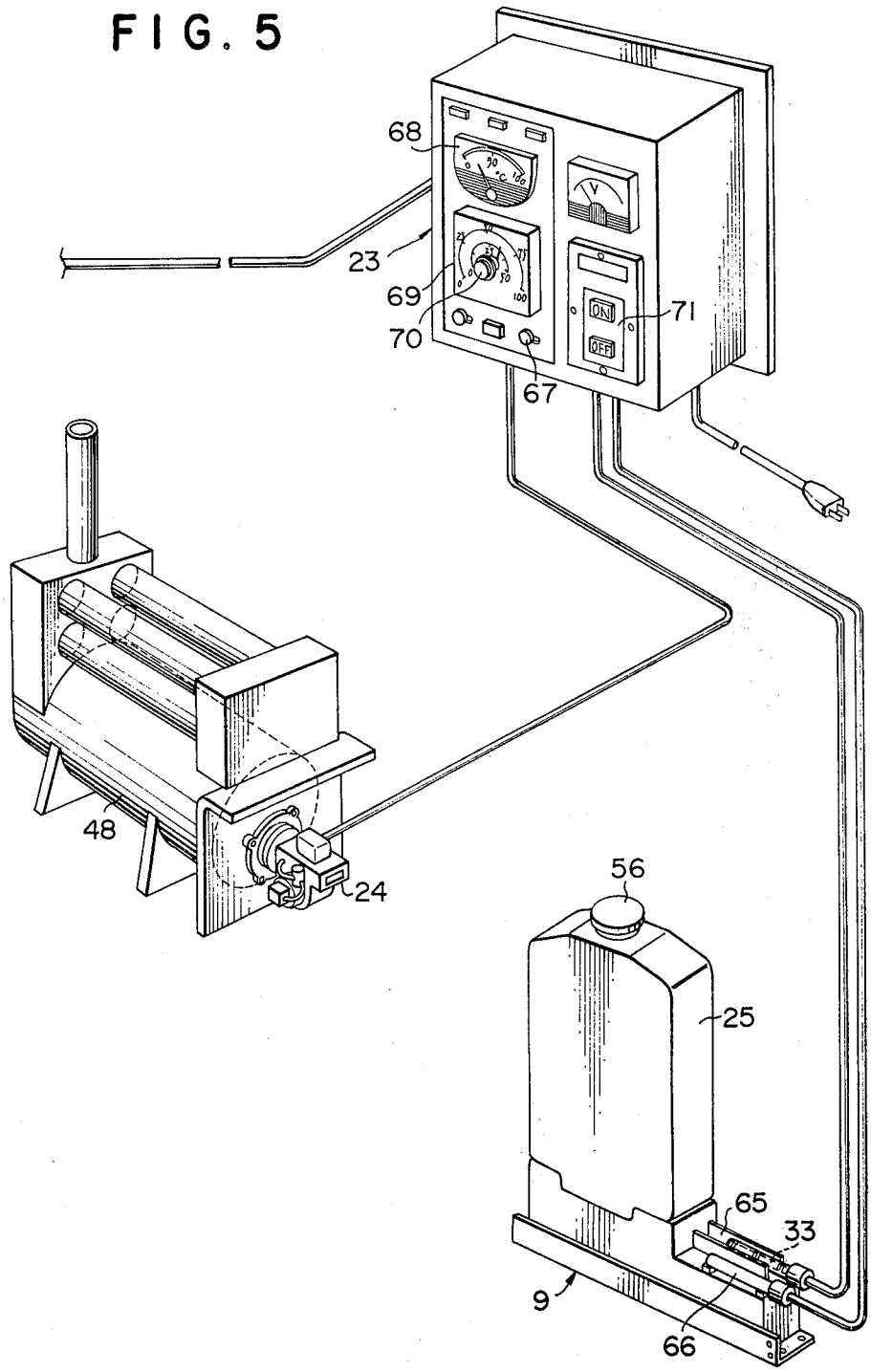
FIG. 5 is a perspective view showing an automatic temperature regulator.

The automatic temperature regulator system C comprises a heater 7 (FIG. 2) arranged in said circulation duct system B, a wet-bulb temperature sensor 9 (FIG. 5) and an automatic temperature regulator 23 adapted to be operated according to indication of said sensor 9.

Figure 6:
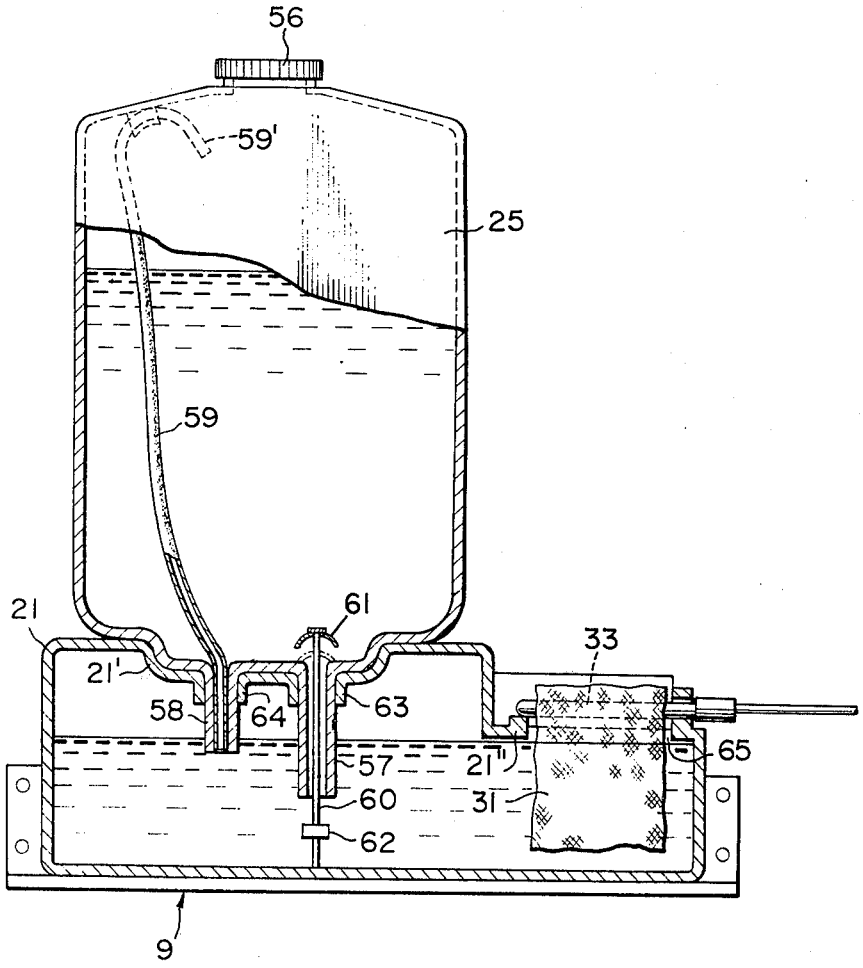
FIG. 6 is a front view showing, partially broken away, a wet-bulb temperature sensor.

The wet-bulb temperature sensor 9 comprises an evaporation water tank 21 (FIG. 6), a reservoir 25 with a control adapted to supply said water tank 21 with water so that said tank may be always filled with water to a predetermined level and a regulator 33 enveloped by a piece of cloth 31 which is partially dipped into said water tank 21. The reservoir 25 includes a cover 56 threaded into the upper portion thereof and a water pipe 57 and an air duct 58 containing different lengths, respectively and extending from the lower portion thereof. An additional duct 59 is connected with said air duct 58 and upper end 59′ of said duct 59 is supported within the reservoir 25 at the upper portion thereof. A stem member 60 of a suitable length is inserted into said water pipe 57 in a vertically movable manner and provided at its upper end with a valve made of a material such as rubber or a synthetic resin which has a substantially inverted cup shape. The lower end of the valve is provided with a weight 62 fixed thereto. The water pipe 57 and the air duct 58 are removably inserted into respective receiving openings 63 and 64.

The evaporation water tank 21 is arranged in the form of an offset tank and includes an upper cover plate 21′ provided with said receiving openings 63 and 64 into which said water pipe 57 and said air duct 58 of the reservoir 25 are snugly inserted, and a lower cover plate 21″ on upper surface. A pair of temperature sensors 33 and 66 are fixedly mounted on the upper surface of the cover plate 21″. A piece of cloth 31 made of cotton cloth or gauze encloses the periphery of one of said temperature sensors 33 and extends through a slit 65 in the lower portion of said sensor 33 into the water so that said sensor 33 actually serves as the wet-bulb temperature sensor 9. The other sensor 66 serves as a dry-bulb thermometer for monitoring.

In supplying water to said reservoir 25, removal of said reservoir 25 from the evaporation water tank 21 causes the valve 61 to close the water pipe 57 in an automatic manner due to the gravity action of the weight 62. Thus the further supply of water causes no overflow of the excess water from said reservoir 25. As the reservoir 25 is reassembled on the water tank 21 by the insertion of nipples 57 and 58 into the receiving openings 63 and 64 of said water tank 21, the lower end of the stem member 60 bears against the bottom surface of the water tank 21 forcing the valve 61 upward so that water in the reservoir 25 may be introduced through the water pipe 57 into the water tank 21 and water may be maintained at a level such that the air duct 58 is effectively sealed.

The wet-bulb temperature sensor 9 and said dry-bulb thermometer 66 respectively include electrical temperature detector members such as thermoelectric couples, thermometric resistors or thermistors and the thermal variation detected by these detective members is transmitted to the automatic temperature regulator 23.

The automatic temperature regulator 23 indicates on a temperature indicator 68 variations appearing on said wet-bulb temperature sensor 9 and said dry-bulb thermometer 66 through the operation of a dry- and wet-bulb temperaure indication change-over switch 67. The temperature regulator thus sets the wet-bulb temperature within the curing barn by operation of a temperature setting knob 70 of an electronic temperature regulator 69. Said electronic temperature regulator 69 is electrically connected to the burner 24 of the heater 7 so that said burner may be automatically ignited or extinguished according to variations appearing on said wet-bulb temperature sensor 9.

The automatic temperature regulator 23 is further connected with the duct fan 6 and a burner ignition switch 71. The operation of the temperature regulator causes rotation of said duct fan 6 arranged in the circulation duct system B and the ignition of said burner 24.

The outlet port control mechanism E is located on the outlet port 14 opening at a side of said curing barn 3 and automatically opens or closes depending on the amount of air which is drawn through the inlet port 10 (FIG. 7) of the inlet port control system D so that the air which has passed through the curing barn 3 may be partially exhausted through the outlet port 14 to the exterior of said barn. The mechanism E assumes the form of a duct wherein a pivot 76 is horizontally suspended at the lower portion of said duct and the lower end of the control plate 34 is fixed to said pivot. A balance weight is mounted on the other end 77 of said plate 34 so that said plate may be normally held in a raised position due to gravity of said balance weight, which closes the outlet port 14. When the inlet port control system D draws in the external air, the pressure of circulating air exceeds the pressure of the atmospheric air by the amount of the drawn in air, and this pressure difference causes the control plate 34 to be opened with a result that the wet air in the curing barn 3 is exhausted to regulate the moisture content in the circulating air.

The tobacco leaf storage casing F comprises a body 15 (FIGS. 9, 10, etc.) and an auxiliary plate 20 both made of a material such as a synthetic resin or a metal.

The body 15 comprises a bottom plate 39 and side plates 36 collapsibly supported on pivots 78 arranged on the opposite side edges of said bottom plate 39, respectively. The body 15 has a U-shaped cross-section when the side plates are in their raised positions.

Each of the side plates 36 is provided at the rear portion 16 thereof with an opening 18 into which a locking projection 79 of the auxiliary plate 20 is engaged and thus the latter is removably secured to the respective side plate. Each of the side plates 36 is further provided at upper portion 17 with a locking hook 19*a* adapted to be engaged into a groove 81 of the auxiliary plate 20 including a pawl 80, an opening 19*b* into which said locking projection 79 of said auxiliary plate 20 is engaged and retractable locking means 82.

Thus, the auxiliary plate 20, in addition to said locking projection 79 adapted to be engaged not only into the opening 18 in the rear portion 16 of said each side plate 36 but also into the other opening 19*b* in the upper portion 17 thereof. The auxiliary plate also has grooves 81 into which the locking hooks 19a on the upper portion 17 of the side plate 36 and the pawls 80 may be disposed (FIGS. 9-12). The auxiliary plate 20 may be removably engaged with the rear and upper surfaces of the body 15.

Figure 17:
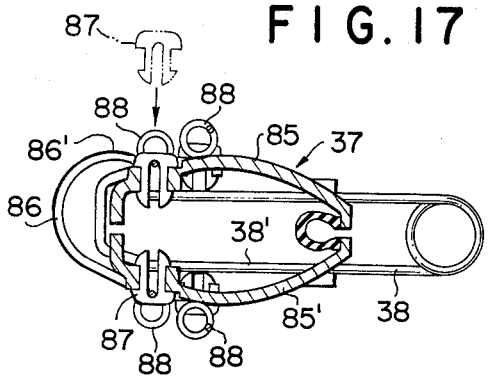
FIG. 17 is a view taken along line 17—17 of FIG. 16.
Figure 18:
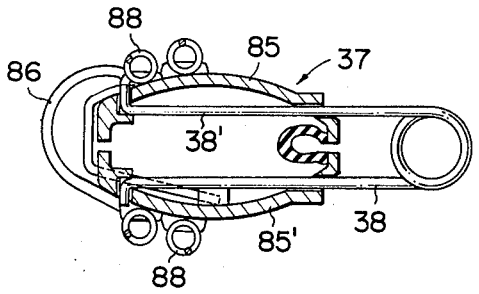
FIG. 18 is a view taken along line 18—18 of FIG. 15.
Figure 19:
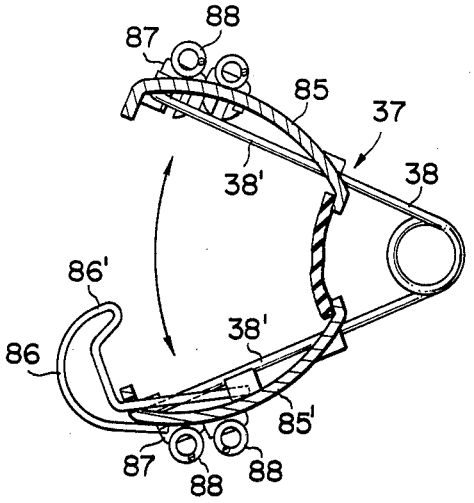
FIG. 19 shows a side section showing the suspending clips in an open position.

Each of the side plates 36 is further provided in the inner surface of the rear portion thereof with a guide groove 84 for removably carrying a suspending clip 37 (FIGS. 17–19).

The suspending clip 37 comprises a pair of holding plates 85 and 85' made of a synthetic resin or a metallic material and disposed in opposition to each other. The holding plates are joined together by a substantially hinge-shaped spring 38 which is provided between both of the holding plates 85 and 85'. Both ends of said spring are fixed to the respective holding plates and thus said holding plates are connected to each other in the form of a hinge and are held in a normally opened position due to the effect of the spring 38. One of the holding plates 85 is provided with a locking piece 86 which holds both holding plates together against the effect of the spring 38. The locking piece 86 is formed from a single metallic bar having a sufficient elasticity, said bar being suitably bent with one end anchored on holding plate 85' and the other end containing a locking portion 86' which is shaped so that in the closed position it extends above the holding plate 85 and is disengageably engaged thereon.

To increase the contact resistance between the bases H' of tobacco leaves H packed in the body 15 and the suspending clip 37, clipping coils 88 extend through a plurality of holder means 87 along the surfaces of both holding plates 85 and 85'.

Figure 20:
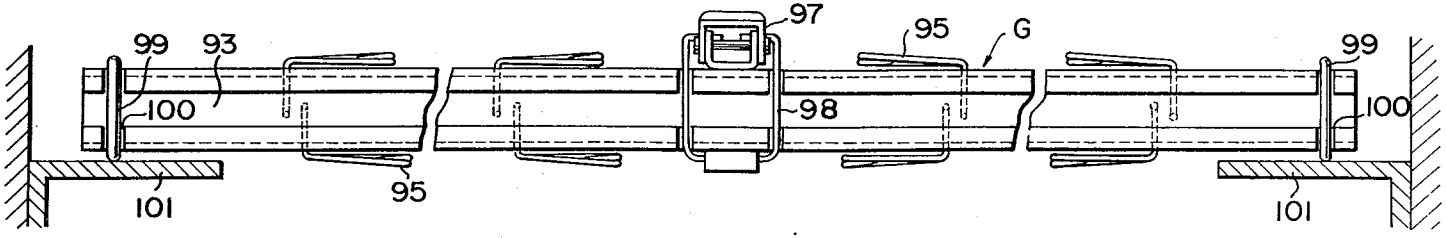
FIG. 20 is a front view of a binder.
Figure 21:
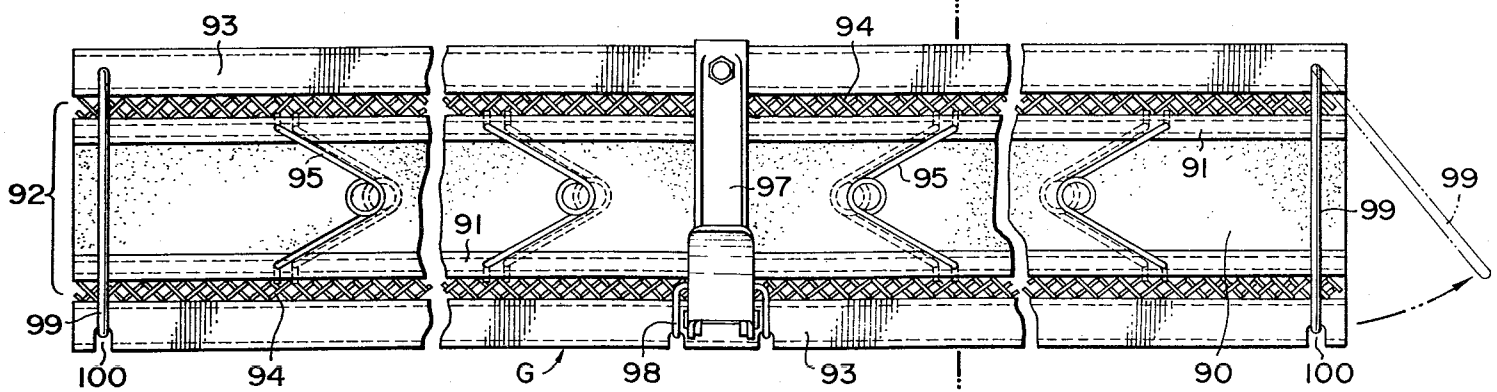
FIG. 21 is a plan view of the binder of FIG. 20.

The means for loading said tobacco leaves H into the curing barn 3 is not limited to the utilization of said tobacco leaf storage casing F but it is also possible, as will be described more in detail, to suspend tobacco leaves with their bases H' held by the binder G (FIG. 22) on supports 101 fixed on side walls in the curing barn 3. The binder G comprises a core 92 including a sponge bar 90 and support plates 91 carried by said sponge bar on opposite sides thereof, holders 93 removably provided in opposition to the respective support plates 91 and suspenders 94 ad 94' fixed on outer sides of said support plates 91 and to inner sides of said holders 93, respectively. The sponge bar 90 may be made of suitable foaming material having a resiliency which has been formed substantially in a band. The sponge bar carried the support plates 91 on opposite sides thereof and is held by resilient bars 95 between both support plates 91. The suspenders 94 and 94' comprise coils of iron wire which are expanded and mounted by hooks 96 on the outer sides of the support plates 91 and on inner sides of the holders 93, respectively. One of the holders 93 includes a grasper 97 having a horizontal U shape in cross section which is, in turn, provided at an end with detachable locking hooks 98 and locking bars 99 (FIG. 20) pivotally mounted on opposite side edges so as to be engaged with respective notches 100. Tobacco leaves H are laterally suspended within the curing barn on the supports 101 with the bases H' of the tobacco leaves being held between the suspenders 94 and 94' which are in turn mounted on support plates 91 and holders 93.

Figure 9:
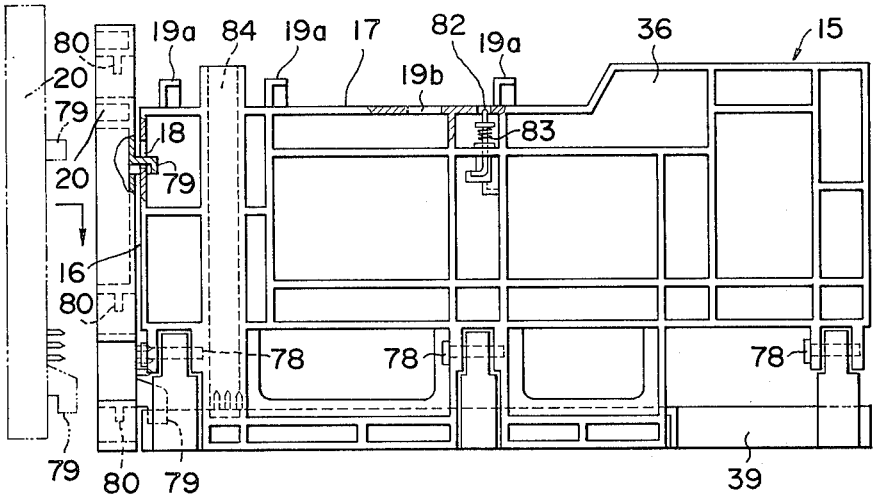
FIG. 9 is a side view showing, partially broken away, a tobacco leaf storage casing.
Figure 10:
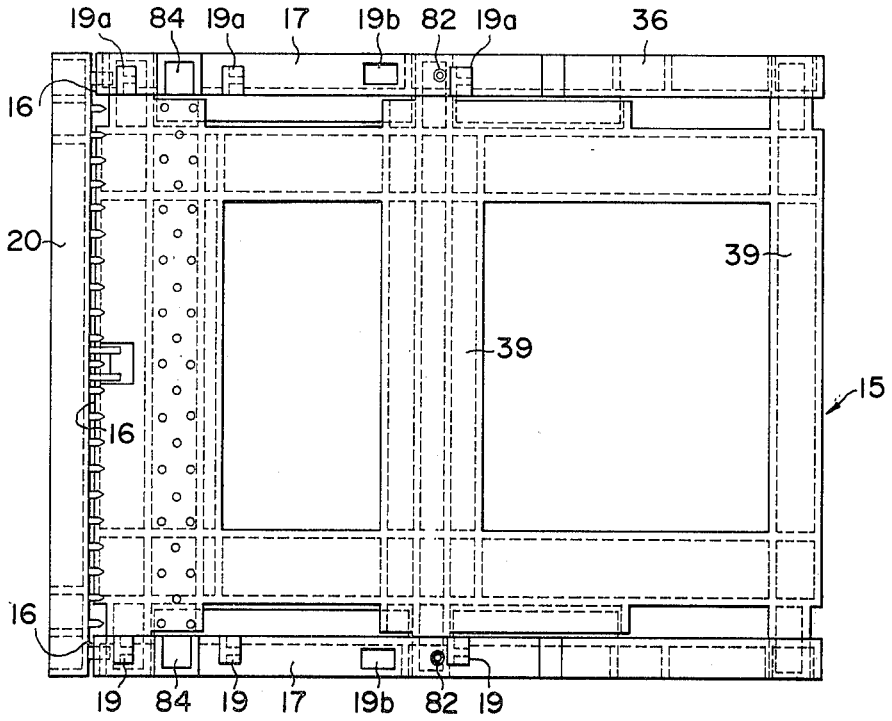
FIG. 10 is a plan view showing the storage casing of FIG. 9.
Figure 11:
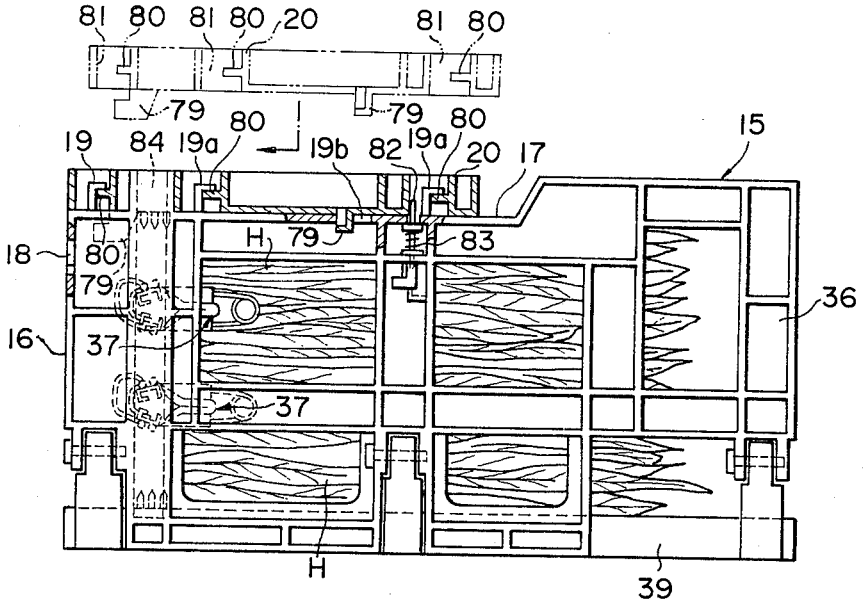
FIGS. 11 and 12 are a side view and a side section illustrating the tobacco leaf pacing apparatus.
Figure 12:
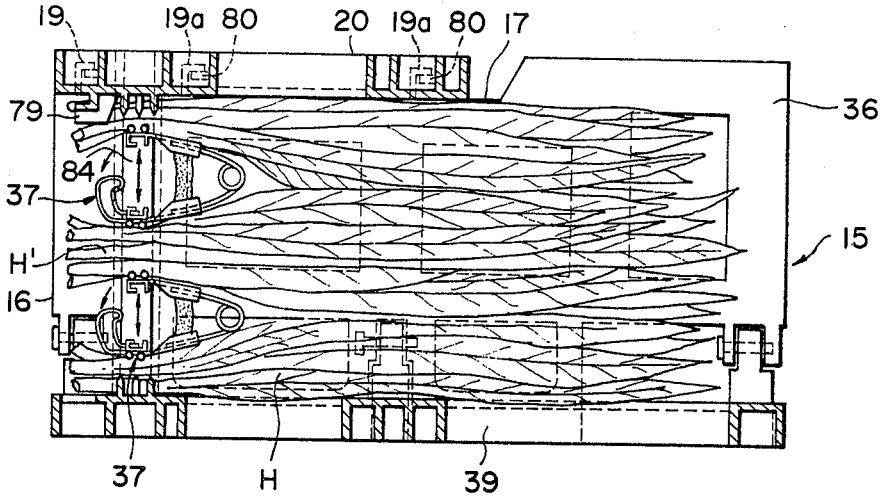
Figure 13:
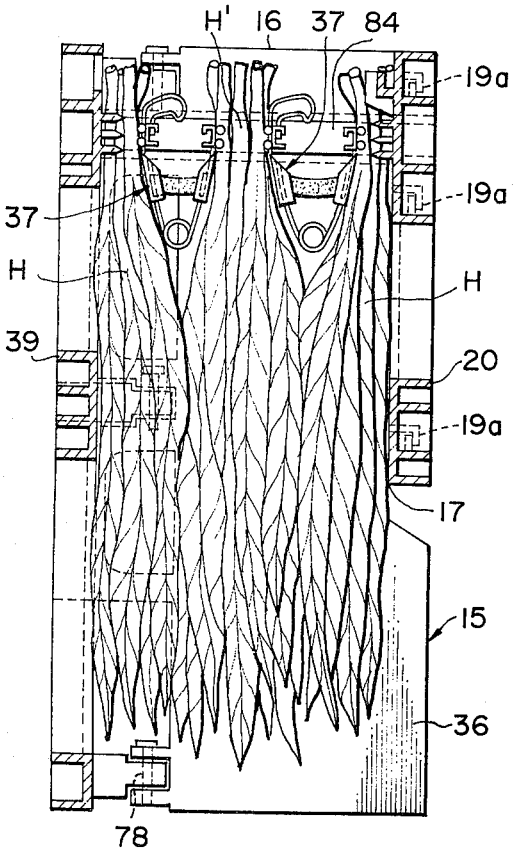
FIG. 13 is a side section showing the tobacco leaf storage casings placed on the floor of the curing barn.
Figure 14:
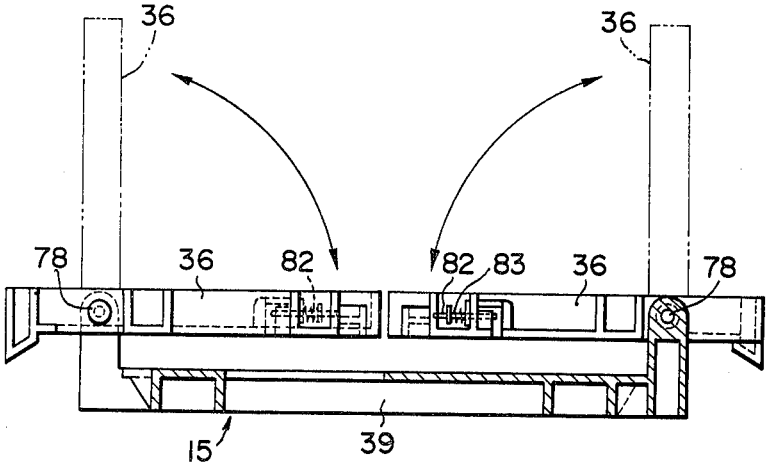
FIG. 14 is a front section showing the collapsible nature of the tobacco leaf storage casing.
Figure 15:
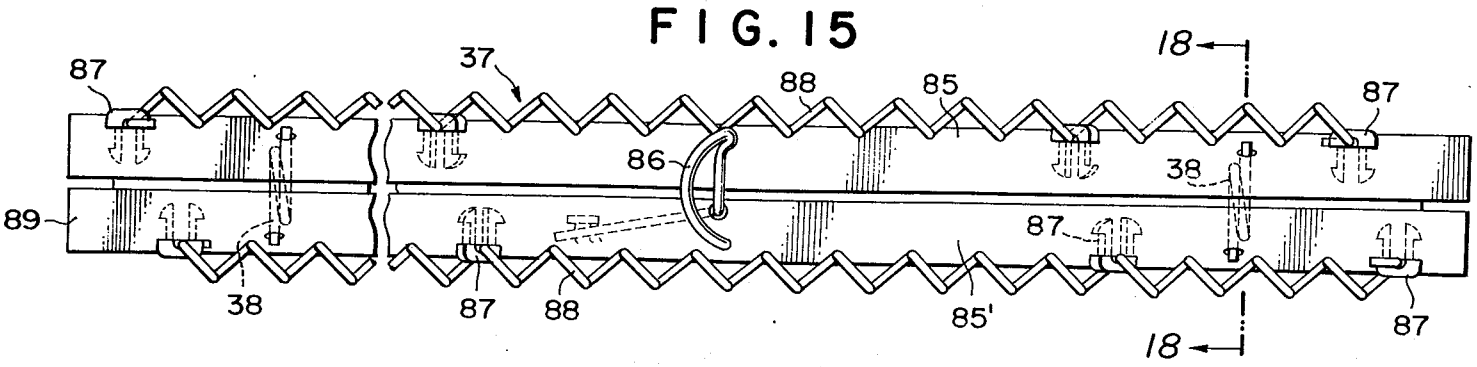
FIG. 15 is a front view showing suspending clips which are carried on the inner surfaces of the rear portions of opposite side plates mounted on the tobacco leaf storage casing for holding the tobacco leaves which are packed into the casing body at the bases of the tobacco leaves.
Figure 16:
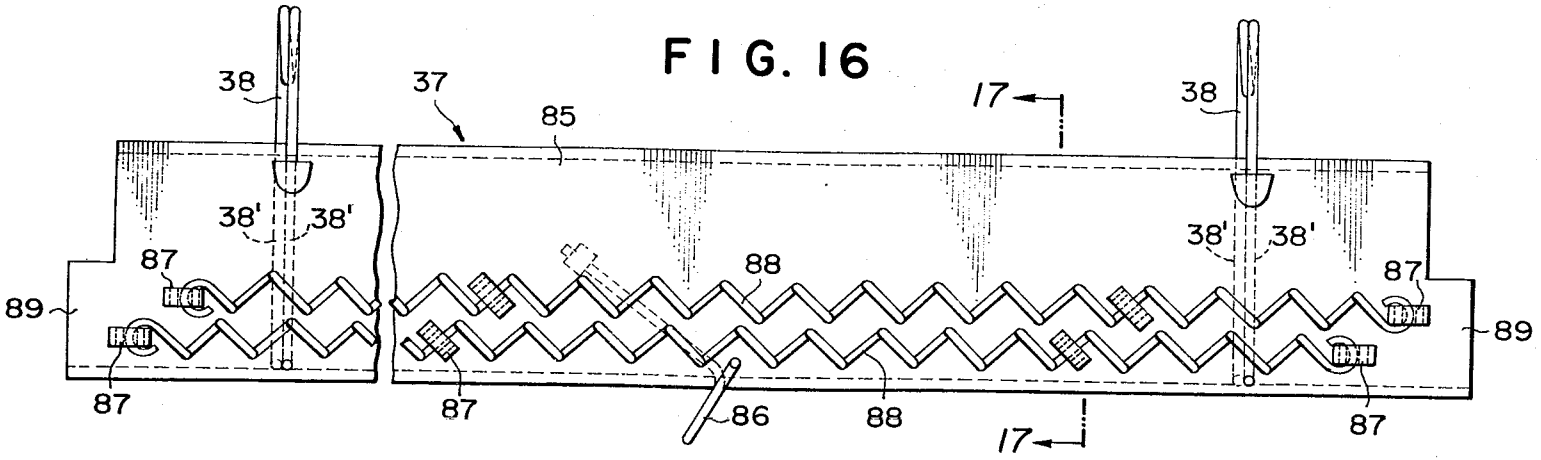
FIG. 16 is a plan view of the suspending clips of FIG. 15.

Now the manner in which the device is used according to the present invention, will be sequentially described with resppect to how the tobacco leaf storage casing F is utilized. Initially, for storage of tobacco leaves H gathered on a farm into the tobacco leaf storage casing F, the side plates 36 are raised from a collapsed position on the bottom plate 39 and the auxiliary plate 20 is engaged into the rear portion 16 thereof as shown by FIGS. 9, 10 and 14. Thereafter the bases H' of tobacco leaves H are aligned by bearing them against the front surface of the auxiliary plate 20 as seen in FIG. 11 and successively piled. Both ends 89 (FIG. 16) of the suspending clips 37 are engaged into the guide grooves 84 provided in both side plates 36 and tobacco leaves H are successively piled together with the suspending clips 37 in an alternate manner.

Upon completion of the leaf packing operation as above mentioned, the auxiliary plate 20 is removed from the rear portion 16 of the body 15 and then engaged into the upper electronic of said body 15. Thereafter, the locking bar 86 of the suspending clip 37 is disengaged so that the holding plates 85 and 85' of said suspending clip 37 may be opened under the effect of the spring and the bases H' of tobacco leaves H packed into the body 15, may be tightly clippped.

Said tobacco leaf storage casings F thus containing said tobacco leaves H are transported by means of a truck from the farm to the curing house A and placed laterally and vertically on the floor 2 of the curing barn 3 with the bases H' of tobacco leaves H being directed upwardly.

The switch 71 of the automatic temperature regulator 23 is now closed to rotate the duct fan 6 and to ignite the burner 24. The temperature setting knob 70 of the e lectronic temperature regulator 69 which is associated with said regulator 23 is set to the desired temperature (i.e., the wet-bulb temperature 38°C) to operate the burner 24 and thereafter the burner 24 itself is automatically ignited when the temperature indication of the wetbulb temperature sensor 9 is lower than that set by the auromatic temperature regulator 23. The burner is automatically extinguished when said temperature indication is higher than that set by the automatic temperature regulator 23, thereby maintaining the wet-bulb temperature within the curing barn 3 at 38°C.

Rotation of said duct fan 6 causes the air within the curing barn 3 to be drawn through the circulation port 5 into the circulation duct system B. The pressure of the air is increased by the duct fan 6, is heated by the heater 7 and is then introduced from the air distribution chamber 32 through the blast port 8 into the blast chamber 4. Then, the air rises through the entire surface of the porous floor plate 2 toward the upper portion of the curing barn 3 at an even temperature, heating or curing tobacco leaves H as the air passes through tobacco leaves H within the storage casing F, from where it is drawn and recirculated by the duct fan 6.

The curing process is usually divided for convenience into a first half period comprising the preheating stage for the fermentation and yellow coloring stage and the second half period comprising the leaf drying stage and the stem drying stage. The curing process will now be described in accordance with such a sequence.

The preheating stage for fermentation is started by ignition and heating with the windows 43 and the doors tightly closed. The purpose of the fermentation stage is to increase the leaf temperature and thereby to facilitate the next coloring stage. About 5% of moisture content in tobacco leaf is removed during this fermentation stage.

The coloring phase is very important in accelerating the curing and chemical change of the ingredients which results in the phenomenon of coloring. During this stage, desiccation is intended while the temperature and the amount of oxygen are maintained best suited for respiration. A principal purpose of this coloring stage is to increase the leaf temperature and thereby to facilitate respiration by circulation of hot air at a high humidity. The hot air at a high humidity has a heat quantity sufficient to control desiccation of tobacco leaf temperature. The leaf temperature thus increased facilitates a respiratory action and accelerates coloring. Substantially 20% of moisture content in tobacco leaves is further removed during this coloring stage.

The leaf drying stage is the stage during which the curing has substantially been completed and the drying or desiccation begins. The purpose of this stage is to color the residual green in stem and to perfect desiccation in the leaf which has already been colored to the extent that said leaf portion is dried in bright yellow. Depending upon the manner of processing during this stage, there may occur a residue of green, coloring in brown or darkening of the color.

To avoid problems such as the darkening of the color, it is desirable that withering of the cells and desiccation should simultaneously take place. Such a requirement is satisfied as described below according to the present invention. From the moment at which the process has transferred to the leaf drying stage, the automatic control means 74 included in the inlet port control mechanism D generates an electric signal at predetermined intervals, causing the electric motor 30 to be rotated for a period of time defined by the timer to which said electric signal is applied. This procedure slightly rotates the damper 11 to open the inlet port 10 in a progressive manner. External air is drawn in through said inlet port 10 under the drawing effect of the duct fan 6 into the circulation duct system B, the amount of drawn in air depending upon the extent of the opening of the inlet port 10. Thus the ratio of said external air mixed with the air within the system is varied to increase the moisture containing capacity of the air and to accelerate the desiccation of the tobacco leaves.

The wet air which has passed through the layers of tobacco leaves H is automatically exhausted through the outlet port 14 in an amount substantially corresponding to the amount of the external air which has been drawn into the system by the mechanism D.

The mechanism D is preset so that the inlet port 10 and the outlet port 14 are fully opened when a dry-bulb temperature of approximately 45°C. is reached. Although the true drying process begins at this moment, leaf desiccation has already been accomplished to the extent sufficient to initiate the so-called falling rate drying phase, so that the extent of the opening in the inlet port 10 is now reduced again to increase a thermal efficiency and to accelerate the inner diffusion of moisture residue in the leaves at a higher temperature. Approximately 60% of the moisture content in the tobacco leaves is further removed during this leaf drying stage.

The tobacco leaves have now been cured except for the stem portion which remains undried through the stages prior to the stem drying stage. In view of the fact that the stem portion has its tissue more compact and tight than that of the leaf portion and, as a result, the inner moisture diffusion is relatively slow, this stage requires a high temperature in the order of 70°C. to increase the drying effect. The need for ventilation is not so serious during this stage, since there is only a small amount of moisture to be evaporated. Consequently, the inlet port 10 has progressively moved to the fully closed position at this stage and the dry-bulb temperature now rises as a result of the heat quantity that would be lost as the latent heat for gasification in the previous stages. Thus, the so-called spontaneous rise in temperature effects drying until the moisture content of the tobacco leaves is sufficiently removed to complete the curing of the tobacco leaves H.

In due consideration of the facts as set forth above, according to the present invention the burner of the heater arranged in the tobacco leaf curing device is adapted to be automatically ignited or extinguished depending on the temperature variation appearing on the wet-bulb temperature sensor located in the curing barn. As a result, in accordance with the present invention, not only the first half of the tobacco leaf curing process but also the second half consisting of the leaf drying stage and the stem drying stage may be effectively controlled so as to stabilize the wet-bulb temperature always at about 38°C. and the leaf curing process may be securely accomplished by the spontaneous rise of the dry-bulb temperature. The problems of program control of the prior art systems may be thus replaced by a fully automatic drying process as defined by the present invention.

The inlet port control mechanism is arranged so that (1) the inlet port is automatically opened in a progressive manner as the leaf drying stage begins and is closed again before the stem drying stage is completed; (2) the external air, the amount of which depends on the extent of the opening of said inlet port, is drawn into the circulation duct system and the wet air which has passed through the layers of tobacco leaves is automatically exhausted through the outlet port by the amount substantially corresponding to the amount of external air drawn by said mechanism into the circulation duct system; and (3) that the rate of the external air mixed into the air in said circulation duct system may be varied to increase or reduce the moisture containing capacity of the air and thereby maintain the humidity within the curing barn most suitable for curing the tobacco leaf. Accordingly, the problems such as residue of green, brown coloring or darkening of color may be avoided in drying the leaf and stem portion to obtain a cured leaf of high quality.

The tobacco leaves gathered on a farm are packed into a casing body with a U shaped cross section, and then said body is closed by the auxiliary plate and the casings containing tobacco leaves stored therein are laterally and vertically placed on the floor of the curing barn to achieve the tobacco leaf curing process according to the present invention. This feature is advantageous, particularly in that a series of operations such as packing tobacco leaves into the casing on the farm, transporting the casings from the farm to the curing barn and storing the casings in the curing barn may be simplified. Thus the tobacco leaves are protected against breakage or damage during these operations and also the time taken for performing these operations is reduced when compared to the processes of the prior art. As a result, the work efficiency of the curing barn and the output of tobacco leaves which have been properly processed are substantially improved.

The invention being thus described, it will be obvious that the same may be varied in many ways. Such variations are not to be regarded as a departure from the spirit and scope of the invention, and all such modifications are intended to be included within the scope of the following claims.

It is claimed:

1. A tobacco leaf curing plant for processing tobacco leaves which comprises a substantially air-tight curing barn divided by a porous floor plate into an upper drying chamber adapted to house the tobacco leaves and a lower air chamber, a circulation duct passageway containing fan means and the heating means, an air circulation port means providing communication between one end of the circulation duct passageway and the drying chamber for drawing air from the drying chamber, and a distribution chamber disposed at the other end of the circulation duct passageway, said distribution chamber providing communicatin between said other end of the circulation duct passageway and the lower air chamber for introducing air compressed by said fan means and heated by said heating means into said lower air chamber, an ambient air inlet port provided with an automatic for controlling the amount of ambient air drawn from the atmosphere through the inlet port and introduced into the air circulation duct passageway so as to change the mixing ratio of the ambient air to the circulating air being supplied to the lower air chamber, an automatic temperature regulator connected to the fan means and the heating means and a wet bulb temperature sensor connected to the automatic temperature regulator, said temperature regulator adjusting the heating means according to variations appearing on the wet bulb temperature sensor, thereby regulating and maintaining the temperature and humidity of the air sent to the lower air chamber at a fixed, predetermined level, and an outlet port means disposed in the wall of the drying chamber for exhausting a portion of the air from the drying chamber to the atmosphere, said outlet port means being provided with a control plate associated therewith, and means for opening or closing the outlet port means depending upon the presure differential between the circulating air inside the drying chamber and the atmospheric air.

2. The tobacco leaf curing plant of claim 1, wherein a plurality of porous baffle plates extend substantially perpendicularly from the porous floor plate into the lower air chamber.

3. The tobacco leaf curing plant of claim 2, wherein the length with which the baffle plates extend from the porous floor plate progressively increases as said baffle plates are further removed from the distribution chamber.

4. The tobacco leaf curing plant of claim 1, wherein the ambient air inlet port containing the automatic control system is disposed between the air circulation port means and the fan means.

5. The tobacco leaf curing plant of claim 1, wherein the air circulation duct passageway is divided by partition means into an upper fan chamber and a lower heating chamber, said upper fan chamber containing the fan means and said lower heating chamber containing the heating means, said upper fan chamber communicating with the drying chamber through said air circulation port means and said upper fan chamber communicating with said lower heating chamber through said fan means mounted in the partition means.

6. The tobacco leaf curing plant of claim 5, wherein the distribution chamber provides communication between the heating chamber and the lower air chamber, said distribution chamber being provided with a plurality of guide plates arranged substantially parallel to each other for directing the heated air uniformally through the air chamber.

7. The tobacco leaf curing plant of claim 1, wherein the ambient air inlet port is provided in the fan chamber and said automatic control system is installed in the inlet port and comprises a hollow cylindrical drum containing opposing air passage openings in its circumferential wall thereby providing communication between the fan chamber and the atmosphere through said inlet port and a damper means slidably disposed within said cylindrical drum, said damper means being provided with motor means for rotating said damper means to open and close the opposing air passage openings and thus the ambient air inlet port.

8. The tobacco leaf curing plant of claim 7, wherein the damper is electrically connected to automatic control means which generates an electrical signal at predetermined intervals for controlling the angular postion of said damper.

9. The tobacco leaf curing plant of claim 1, wherein the wet bulb temperature sensor is located at the forced, heated air inlet side of the drying chamber.

10. The tobacco leaf curing plant of claim 9, wherein the wet bulb temperature sensor includes an evaporation water tank, a reservoir adapted to supply said water tank with water, and including means whereby said tank is filled to a predetermined level, said temperature sensor being enveloped by a piece of cloth which is partially disposed in the water.

11. The tobacco leaf curing plant of claim 1, wherein storage casings are disposed on opposite sides of the porous floor plate and the tobacco leaves are packed in said storage casings.

12. The tobacco leaf curing plant of claim 1, wherein the drying chamber contains side walls and support members are fixed to said side walls said support members being provided with leaf hanging bars which hold the tobacco leaves by their bases.

13. The tobacco leaf curing plant of claim 1, wherein the storage casings have a U-shaped cross-section provided with front and rear portions, said casings containing locking hooks with auxiliary plates detachably fixed thereto, said casings being adapted to be packed in the field with tobacco leaves for curing in the leaf curing plant.

14. The tobacco leaf curing plant according to claim 13, wherein each of the side plates of the U-shaped casing is fitted in the inner surface of the rear portion thereof with suspender clips which open under spring pressure, thereby holding the stem base portions of the tobacco leaves in a suspended state.

15. The tobacco leaf curing plant of claim 12, wherein the hanging bars comprise a core including a sponge bar, support plates carried by said bar on opposite sides thereof, holders removably provided in opposition to the respective ones of said plates, said suspenders fixed to the outer sides of the plates and to the inner sides of the holders, respectively, the stem bases of said leaves being held between the bar and suspenders so that the leaf hanging bars clamping the leaves can be hung on hooks secured to both sides of the leaf curing plant.

16. The tobacco leaf curing plant of claim 1, wherein the heating means is a heat exchange device provided with a burner, said temperature regulator being connected to said burner.

* * * * *